US007584566B2

(12) United States Patent
Victor et al.

(10) Patent No.: US 7,584,566 B2
(45) Date of Patent: Sep. 8, 2009

(54) SECURING SYSTEM WITH HOUSING FOR HARDWARE

(75) Inventors: Hugh Victor, 25467 Wareham Dr., Huntington Woods, MI (US) 48070; Steven Lawrence Carolin, Lake Orion, MI (US)

(73) Assignee: Hugh Victor, Huntington Woods, MI (US)

( * ) Notice: Subject to any disclaimer, the term of this patent is extended or adjusted under 35 U.S.C. 154(b) by 0 days.

(21) Appl. No.: 11/836,442

(22) Filed: Aug. 9, 2007

(65) Prior Publication Data

US 2008/0034635 A1 Feb. 14, 2008

Related U.S. Application Data

(60) Provisional application No. 60/822,158, filed on Aug. 11, 2006.

(51) Int. Cl.
*F41A 17/00* (2006.01)

(52) U.S. Cl. ..... 42/70.07; 42/70.06; 42/70.11

(58) Field of Classification Search ..... 42/70.07, 42/70.11, 70.06
See application file for complete search history.

(56) References Cited

U.S. PATENT DOCUMENTS

| | | | | |
|---|---|---|---|---|
| 3,624,945 | A | | 12/1971 | Foote |
| 3,637,180 | A | | 1/1972 | Parry |
| 3,664,163 | A | | 5/1972 | Foote |
| 4,855,713 | A | | 8/1989 | Brunius |
| 4,864,636 | A | | 9/1989 | Brunius |
| 5,022,534 | A | | 6/1991 | Briggs |
| 5,196,827 | A | | 3/1993 | Allen et al. |
| 5,271,174 | A | | 12/1993 | Bentley |
| 5,283,971 | A | | 2/1994 | Fuller et al. |
| 5,309,661 | A | * | 5/1994 | Fuller et al. ..... 42/70.07 |
| 5,392,551 | A | * | 2/1995 | Simpson ..... 42/70.07 |
| 5,487,234 | A | * | 1/1996 | Dragon ..... 42/70.07 |
| 5,525,966 | A | | 6/1996 | Parish |
| 5,561,935 | A | | 10/1996 | McCarthy et al. |
| 5,579,923 | A | * | 12/1996 | Hemmerlein ..... 211/4 |
| 5,621,996 | A | * | 4/1997 | Mowl, Jr. ..... 42/70.07 |
| 5,638,627 | A | | 6/1997 | Klein et al. |

(Continued)

FOREIGN PATENT DOCUMENTS

DE 2614250 10/1977

(Continued)

OTHER PUBLICATIONS

International Search Report dated May 6, 2005. PCT/US04/041862.

(Continued)

*Primary Examiner*—Stephen M Johnson
*Assistant Examiner*—Daniel J Troy
(74) *Attorney, Agent, or Firm*—Dobrusin & Thennisch PC

(57) ABSTRACT

A securing system that includes a first wall portion adapted to be attached to a surface; and a second wall portion separable from the first wall portion and adapted to be removable engaged with the first wall portion; the second wall portion including an opening for receiving a projecting member from a male portion of a locking mechanism, wherein the second wall portion is disposed between the male portion and the female portion of the locking mechanism.

9 Claims, 5 Drawing Sheets

U.S. PATENT DOCUMENTS

| | | | | |
|---|---|---|---|---|
| 5,720,193 | A | 2/1998 | Dick | |
| 5,761,206 | A | 6/1998 | Kackman | |
| 5,805,063 | A | 9/1998 | Kackman | |
| 5,809,013 | A | 9/1998 | Kackman | |
| 5,832,647 | A * | 11/1998 | Ling et al. | 42/70.07 |
| 5,899,102 | A * | 5/1999 | Ling | 70/312 |
| 5,918,402 | A * | 7/1999 | Weinraub | 42/70.07 |
| 5,942,981 | A | 8/1999 | Kackman | |
| 6,209,251 | B1 * | 4/2001 | Avganim | 42/70.07 |
| 6,269,575 | B1 * | 8/2001 | Chang | 42/70.07 |
| 6,308,540 | B1 * | 10/2001 | Lee | 70/58 |
| 6,330,815 | B1 * | 12/2001 | Duncan | 70/58 |
| 6,339,892 | B1 * | 1/2002 | Ramos | 42/70.07 |
| 6,429,769 | B1 | 8/2002 | Fulgueira | |
| 6,474,238 | B1 * | 11/2002 | Weinraub | 42/70.07 |
| 6,601,332 | B1 * | 8/2003 | Riebling | 42/70.11 |
| 6,722,071 | B1 * | 4/2004 | Lin | 42/70.07 |
| 7,116,224 | B2 | 10/2006 | Mickler | |
| 7,281,397 | B2 * | 10/2007 | Victor | 70/58 |
| 7,367,150 | B2 * | 5/2008 | Farchione et al. | 42/70.07 |
| 2002/0069569 | A1 * | 6/2002 | Riebling et al. | 42/70.07 |
| 2003/0213273 | A1 | 11/2003 | Vercoe | |
| 2005/0229654 | A1 * | 10/2005 | Victor | 70/58 |
| 2006/0112605 | A1 * | 6/2006 | Sopko | 42/70.11 |
| 2006/0117633 | A1 * | 6/2006 | Chang | 42/70.07 |
| 2007/0051026 | A1 * | 3/2007 | Vor Keller | 42/70.11 |

FOREIGN PATENT DOCUMENTS

| | | |
|---|---|---|
| DE | 29921048 | 4/2001 |

OTHER PUBLICATIONS

"Recessed Micro Door/Window Sensor" Document No. 466-1502 Rev. C ~ May 2000.

Master Lock ~ http://www.masterlock.com/cgi-bin/class_search.pl ~ Product No. 90,94.

Master Lock ~ http://www.masterlock.com/cgi-bin/class_search.pl ~ Product No. 106.

Co-pending Office Action mailed May 21, 2009, U.S. Appl. No. 11/860,781, filed Sep. 25, 2007.

* cited by examiner

SECURING SYSTEM WITH HOUSING FOR HARDWARE

CLAIM OF BENEFIT OF FILING DATE

The present application claims the benefit of the filing date of U.S. Application Ser. No. 60/822,158, filed Aug. 11, 2006, hereby incorporated by reference.

TECHNICAL FIELD

The present invention relates generally to a securing system, and in one particular aspect to a monitored securing system that includes a gun protection feature.

BACKGROUND

In recent years, there has been an increase in the number of jurisdictions that are requiring gun owners to securely stow their weapons when not in use. This has resulted in an increase in the number of locking mechanisms, particularly locks for preventing accidental discharge of weapons. Various commercially available examples of such locking mechanisms currently exist, with many of them functioning by the use of a locking cable, bar or other detent structure that, when attached to the gun, prevents the trigger from being squeezed.

In addition to the foregoing, there have been efforts by some to provide a securing system that includes a feature for particularly storing a weapon. Examples of such systems include those described in U.S. Pat. Nos. 5,196,827; 5,525,966, 5,487,234 and 6,429,769, hereby incorporated by reference.

Nothwithstanding the above efforts, there remains a need for a relatively simple, inexpensive, but effective approach to securing a gun or other device, such as a device that is trigger operated, and particularly an approach that can be readily assimilated into a securing system, such as a residential security system, a commercial security system, a mobile security system or otherwise.

SUMMARY OF THE INVENTION

The present invention meets the above needs by providing a securing system that includes a first wall portion adapted to be attached to a surface; and a second wall portion separable from the first wall portion and adapted to be removable engaged with the first wall portion; the second wall portion including an opening for receiving a projecting member from a male portion of a locking mechanism, wherein the second wall portion is disposed between the male portion and the female portion of the locking mechanism.

DETAILED DESCRIPTION OF THE INVENTION

Figure 1:
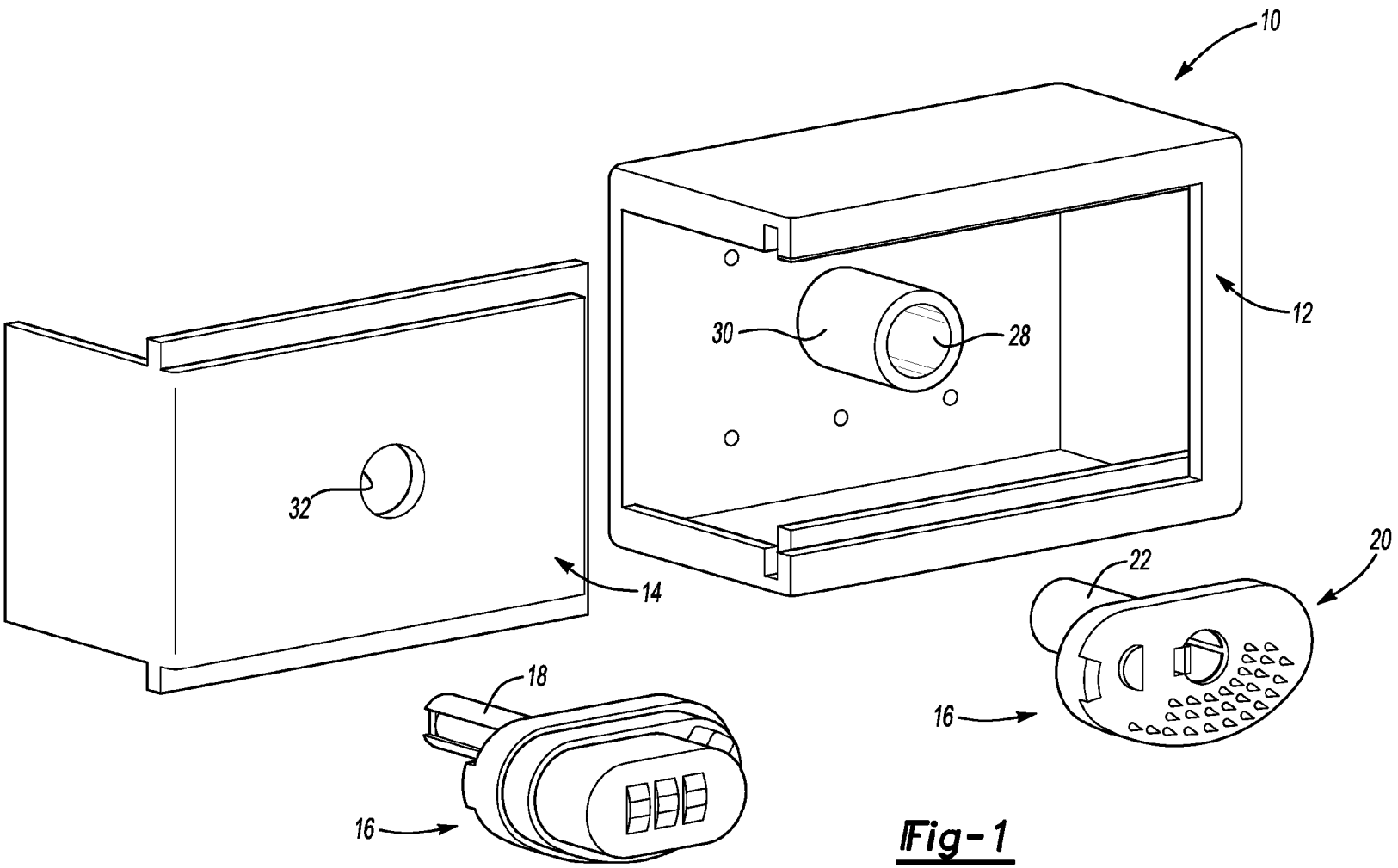
FIGS. 1-4 depict an illustrative example of a device in accordance with the present invention.
Figure 2:
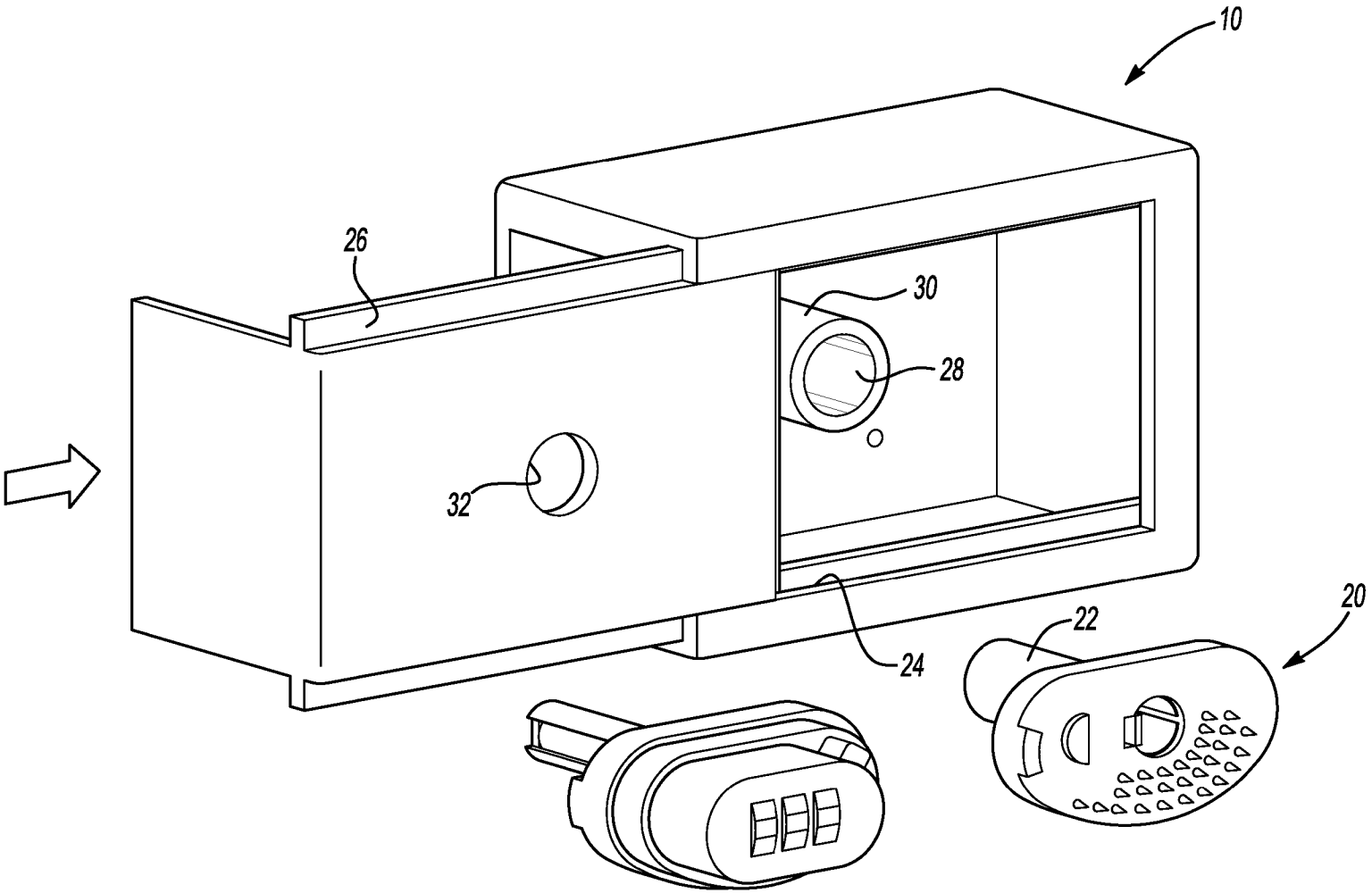
Figure 3:
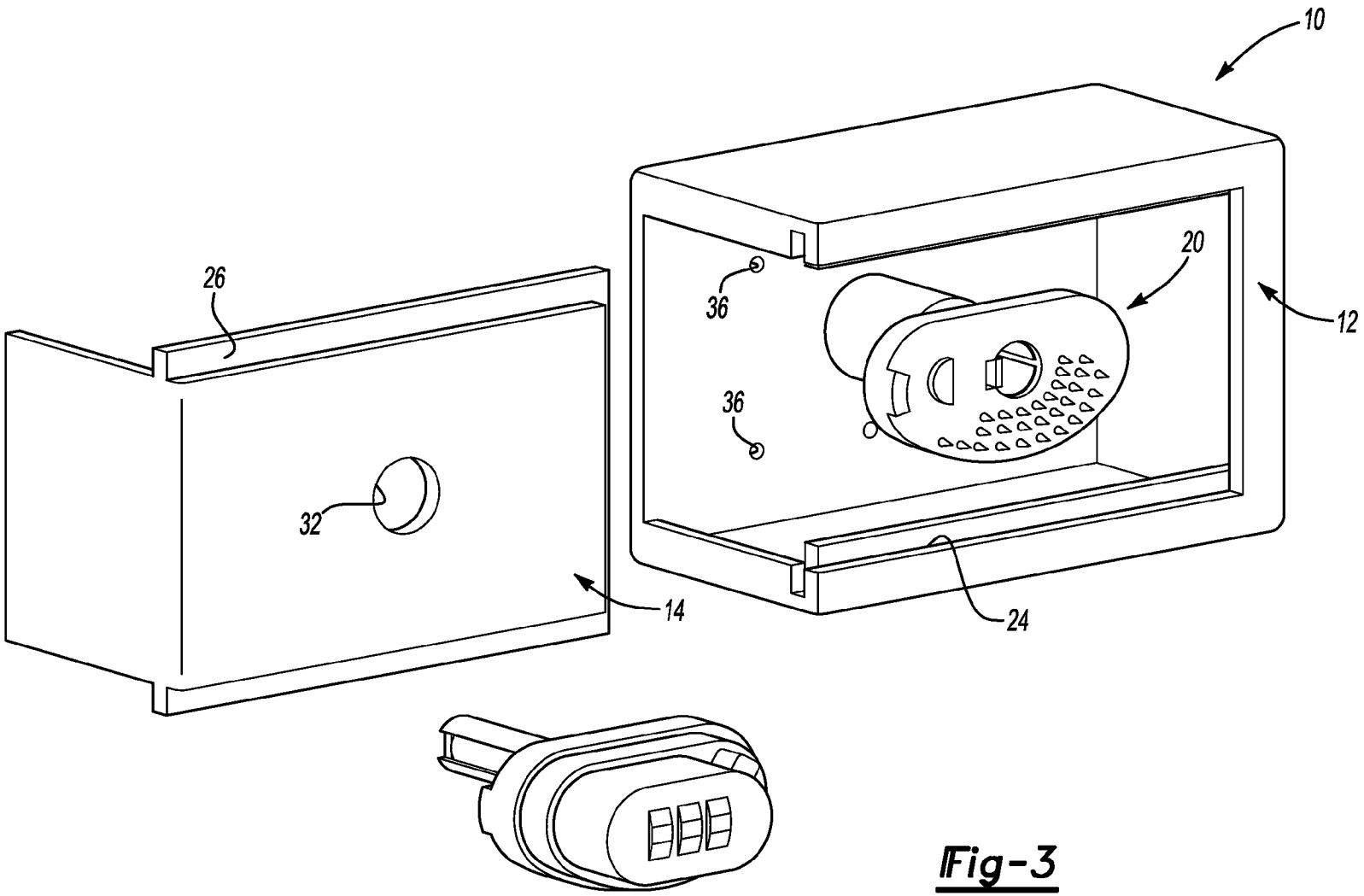

The present invention is directed to improvements in and to the subject matter of co-pending Published U.S. Patent application 2005/0229654, hereby incorporated by reference.

The present invention is directed to a structure adapted to be permanently or temporarily mounted to a surface (e.g., wall, a floor, a ceiling, a horizontal work surface, a door, a decorative trim panel, a piece of furniture, a storage container, a countertop, a drawer, a stud, a vehicle body in white, a vehicle trim, a vehicle frame, or any combination thereof) for receiving a firearm or other article that is secured with locking mechanism that includes at least two separable portions, each including a plate section. The structure generally comprises a first wall portion for mounting to a surface, and a second wall portion that is detachable from the first portion. The second wall portion includes an aperture through which a shank of the locking mechanism can pass, but which is dimensioned for preventing the plate sections of the separable portions from passing therethrough. The second wall portion is removably secured to the first wall portion in a suitable manner. For example, the respective wall portions may be fastened to each other, they may be interference fit relative to each other, they may be snap fit to each other, they may be friction fit relative to each other, they may be hinged to each other, they may be pivotally mounted relative to each other, or any combination thereof.

The first wall portion preferably includes one or more apertures for receiving a fastener to temporarily or permanently mount the first wall portion to a surface. Mounting may be done with a suitable adhesive as well. Other attachment approaches are possible including those disclosed in Published U.S. Patent application 2005/0229654. In general, it is contemplated that the mounting hardware will be concealed from view, and generally inaccessible in use.

The first wall portion may also include a structure adapted for receiving, in generally mating relationship, one of the separable portions of the locking mechanism. For example, a hollow post (which optionally may include a relatively high friction inner wall surface (e.g., from an elastomeric coating, liner or sleeve)) that is dimensioned to substantially correspond with an opposing structural member associated with the separable portion of the locking mechanism, may project from the wall portion.

The first or the second wall portion may include ornamentation as desired. In one aspect of the invention the second wall portion is adapted to be interchangeable with other second wall portions. Thus, a user has the option of changing the appearance of the assembly, or customizing the assembly. For example, the second wall portion may have a flat external surface, a contoured surface, or a combination of both. The second wall portion may include a regular geometric shape. It may include an arbitrary shape (e.g., a custom designed shaped, a logo, an initial, or otherwise). The second wall portion may be a metal, a plastic, a ceramic, or a combination thereof. It may include a plurality of layers (e.g., as a laminate). It may include a pattern or a weave. For example the second portion may include a fibre weave (e.g., from use of a carbon or plastic, such as an aramid fiber). The external finish may be dull, bright, reflective, transparent, opaque, smooth, textured or any combination thereof.

The present invention finds particular application for use with a gun lock of the type depicted in Published U.S. Patent application 2005/0229654, and U.S. Pat. Nos. 6,308,540 and 5,621,996. Examples of mechanisms that could be adapted for use in the present invention include, without limitation, those available from Pro-Lok® under the designation GUN-LOK™, those available from Master Lock, under one or more of the designations 940SPT (combination), 90KADSPT (key), 90 (key), or the like. Other examples include those in U.S. Pat. Nos. 6,474,238, 5,918,402, 5,638,627, 5,487,234 or the like, all of which are hereby incorporated by reference. The present invention advantageously contemplates retrofitting one or more components of the above types to form an assembly as described herein. However, independently fabricated structures may also be used.

With reference to the specific examples herein, as shown in FIGS. 1-4, there is seen one illustrative example of a securing structure 10 that includes a first wall portion 12 and a second wall portion 14. In the example shown, the second wall portion 14 is adapted for engagement (e.g., sliding engagement) with the first wall portion 12. A lock mechanism 16 is depicted as having a male portion 18 for matingly engaging a female portion 20 that include a hollow stem 22 for receiving the male portion. In the embodiment shown, an undercut groove 24 is defined in one of the first or the second wall portions for receiving a tongue 26 defined in the other of the first or the second wall portions. The securing structure 10 preferably also includes a recess defined therein for receiving the stem 22 of the female portion. For example, as shown, a recess 28 is defined in a post 30 formed in the first wall portion 12. The second wall portion 14 includes an opening 32. The locking mechanism shown in FIGS. 1-4 includes a combination device 34. Other suitable lock devices may be employed.

Figure 4:
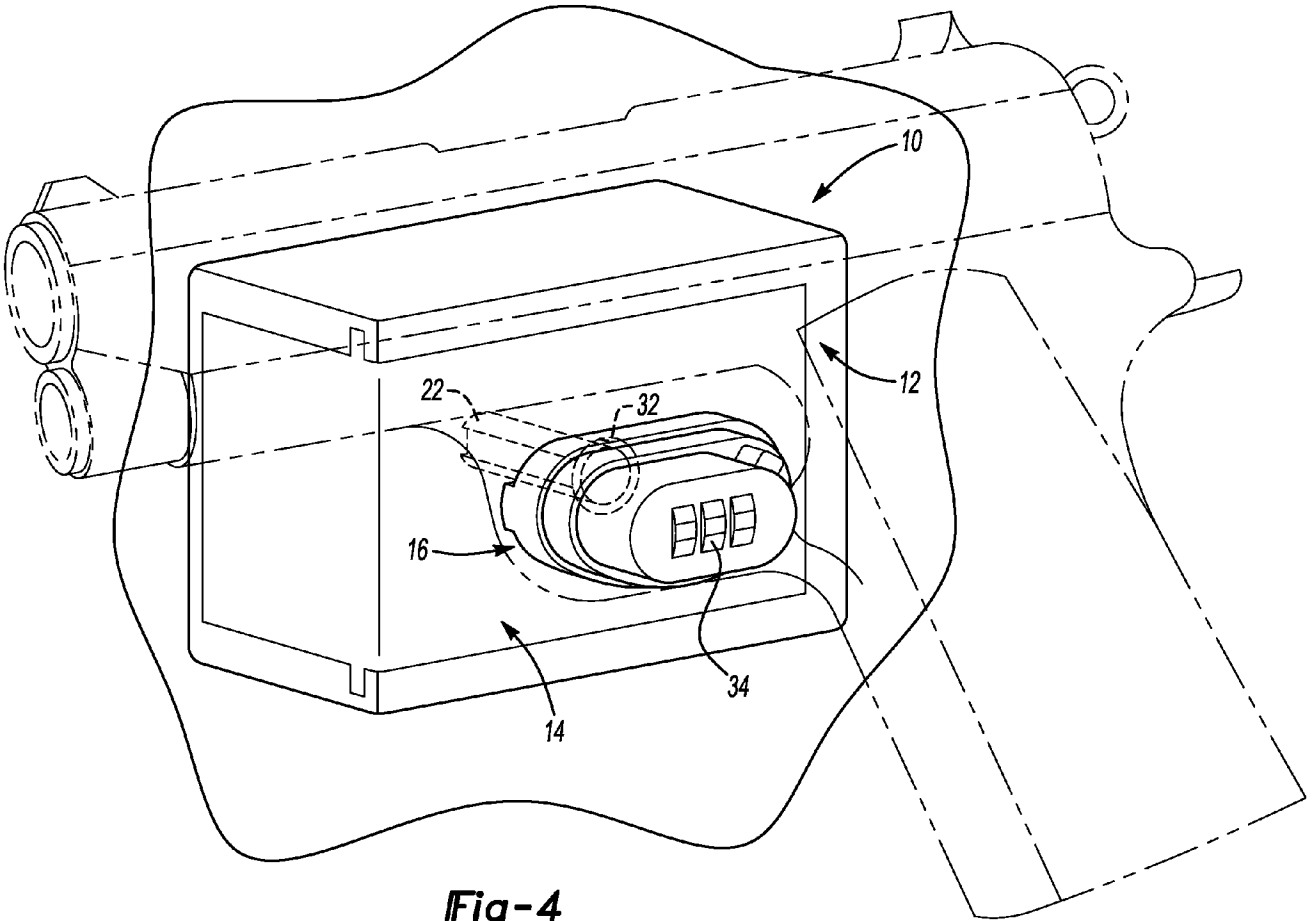

In use, the first wall portion 12 is mounted to a surface, such as by fasteners through openings 36. The stem 22 of the female portion 20 of the locking mechanism is inserted into the recess 28. The second portion is placed over the female portion 20, so that the hollow stem 22 is substantially aligned with the opening 32. An article to be secured (e.g., a firearm) is placed between the second wall portion 14 and male portion 16 of the locking mechanism and the male and female portions of the locking mechanism are mated together in locking engagement. FIG. 4 illustrates the relationship, with the article to be secured in phantom.

Figure 5:
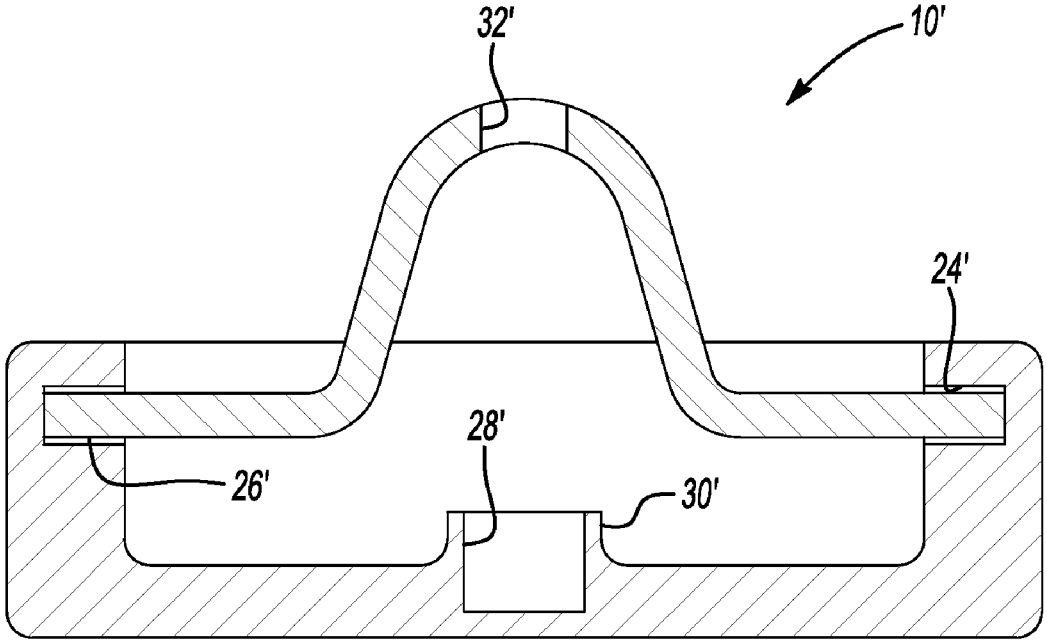
FIG. 5 illustrates an alternative structural configuration of a device in accordance with the present invention.

FIG. 5 illustrates a sectional view of another alternative to show a lower profile configuration. One benefit of the structure of FIG. 5 is that the second wall portion is that it can exhibit a constant profile along its length, thus rendering it suitable for manufacture by extrusion or pultrusion.

It should be appreciated that the present invention finds particular suitability in connection with helping to secure firearm weapons against misuse. However, it also has broader application in connection with other systems where it is desired to help secure articles in a fixed location, and/or with respect to some articles, to help prevent trigger actuation of a device, including trigger actuated hand tools or power tools such as saws, drills, mills, nail guns, staple guns, or the like, kitchen utensils, pesticide dispensers, paint or other surface coating sprayers, powered surgical instruments, other fluid dispensers, or the like. Other household, commercial or industrial articles requiring securing (e.g., cutting implements, narcotics, alcoholic beverages, cash, negotiable instruments, securities or otherwise) may also be secured using the present invention, and such articles need not be trigger operated. Further, it should be appreciated that even though the invention is illustrated with particular reference to a residential, commercial or mobile securing system, it is suitable for many other applications. In addition, though in some embodiments the present invention contemplates the installation of complete securing systems that incorporate components of the present invention, it is contemplated that certain existing systems may be retrofitted with a device of the present invention, and such retrofitting is contemplated as within the present invention.

The present invention may also be adapted for enabling the use of an optional sensing portion (e.g., a two-piece separable sensor that communicates a signal when separated), such as may be part of an alarm system, in accordance with the teachings of Published U.S. Patent application 2005/0229654, incorporated by reference.

It should be realized that as shown in the drawings herein, the relative positioning of the male and female components may be interchanged. Either one of the male or the female components may be integrally formed with the first or the second wall portions. Further, though a number of embodiments herein illustrate a projection of the male component generally perpendicular relative to the mount portion, other orientations are also possible, including at an angle greater than or less than 90 degrees, or generally parallel relative to the mount portion.

The separable portions (of the wall portions, the locking portions or both) need not be entirely separable from each other, and thus could include two or more portions that are hinged, tethered or otherwise connected relative to each other.

Another possible approach is to employ a hinge structure that allows for both pivotal movement of a portion and sliding motion.

One or more portions that are to come into contact with a trigger operated device will include a relatively soft resilient surface to avoid marring or scratching of the triggered device. One embodiment contemplated the use of one or more pads, made of a relatively soft material, such as a plastic (e.g., a polyolefin, a fluorinated polymer (e.g., PTFE), or another plastic), a natural rubber, a synthetic rubber, woven cloth, unwoven cloth, felt, combinations thereof, or the like.

The first wall portion and the second wall portion may be fabricated from the same processing technique (e.g. stamped, cast, injection molded, blow molded, rotational molded, thermoformed, compression molded, or otherwise). In one aspect, they are fabricated from dissimilar techniques. For example, one of the portions is roll formed, extruded or pultruded for defining a predetermined substantially constant profile, and the other portion is stamped, cast, injection molded, blow molded, rotational molded, thermoformed, compression molded, or otherwise fabricated.

In general, the separable portions of the locking mechanism will cooperate for securing an article to be secured therebetween, such as a firearm. Any suitable locking mechanism may be employed for releasably attaching the separable portions, ranging from a keyed lock, a combination lock, an electronically controlled lock, an actuatable member (e.g., a latch, a deadbolt, a cam lock, a hook, or the like) such as a solenoid driven member, which is manually actuated or actuated in response to a signal from a touch screen, a key pad, identification badge (including for example cards and tags as well), bar code, visual scan, active or passive radiofrequency identification device (RFID), a biometric scan (e.g., an eye, face, finger, hand or DNA scan) or the like, or some other suitable mechanism.

Any of the portions can integrally be assembled into one piece and need not be separated or relocated to another portion.

Reference to "gun holder portion" or other "gun"-specific references are not intended as limiting the invention solely to the use of guns. As discussed, other devices, and particularly trigger actuated devices can be secured using the present invention, with the "gun holder portion" or other "gun"-specific component being adapted for the particular device desired to be secured. Further use of "wireless" refers to the absence of wires as the primary signaling link between devices, and does not preclude the existence of wires contained within a device. Without limitation, wireless devices may upon a form of optical, thermal or other detectable electromagnetic signal to achieve signaling communication. References to "first" or "second" are not intended to exclude the presence of additional components. Nor are they intended necessarily to denote a particular sequence.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes.

What is claimed is:

1. A gun securing device comprising:

a first wall portion that is attached to a surface wherein the first wall portion is attached to a support structure or removably attached to the support structure by fasteners that penetrate apertures in the first wall portion; and a second wall portion separable from the first wall portion and that slidingly engages with the first wall portion by way of a complementary tongue and groove structure defined in the first and second wall portions to define an enclosure that conceals each of the fasteners used to attach the first wall portion to the support structure;

a locking mechanism that is removable from the first and second wall portions, the locking mechanism including a male portion that blocks a trigger of a gun secured therein and is separable from a female portion, wherein the second wall portion include an opening for receiving a projecting member from the male portion of the locking mechanism, and wherein the second wail portion is disposed between the male portion and a female portion of the locking mechanism, and one of the male portion or the female portion is removably contained within the enclosure.

2. The securing device according to claim 1, wherein the second wall portion is contoured.

3. The securing device according to claim 1, wherein the second wall portion has a substantially constant profile along its length.

4. The securing device according to claim 1, wherein the first wall portion and the second portion include a flush fit outer surface at a joint between the two.

5. The securing device according to claim 1, wherein upon assembly, one of the male portion or the female portion of the locking mechanism is concealed from view, and further wherein upon attachment of the device to a surface, any fasteners for attaching to the surface are concealed from view.

6. The securing device according to claim 5, wherein the first wall portion and the second portion include a flush fit outer surface at a joint between the two, and further wherein the outer surface is substantially planar at the joint, and the groove includes an undercut groove.

7. The securing device of claim 6, wherein the first wall portion includes a recess defined therein for receiving a stem on the female portion of the locking mechanism.

8. A gun securing device comprising:

a first portion including a base wall that is attached with fasteners to a support structure, and an opposing side wall structure; and a second portion that is separable from the first portion and that slidingly engages with the first portion by way of a complementary tongue and undercut groove structure defined by the opposing side wall structure of the first portion and the second portion;

a locking mechanism removable from the first portion and the second portion, and including a male portion having a projecting member, which blocks a trigger of a gun secured therein, and being separable from a female portion that includes a hollow stem that receives the projecting member;

wherein the first portion includes a post, having a recess, defined in the base wall of the first portion, which receives the hollow stem on the female portion of the locking mechanism;

wherein the second portion includes an opening, which is smaller than the largest width of the female portion, which is generally aligned with the recess of the post, and through which the projecting member from the male portion of the locking mechanism passes so that the second wall portion is disposed between the male portion and the female portion of the locking mechanism when assembled;

wherein upon assembly, the female portion of the locking mechanism is enclosed and concealed from view by the second portion;

wherein upon attachment of the device to the support structure, any fasteners for attaching to the surface are concealed from view by the second portion; and further wherein the first portion and the second portion include a flush fit outer surface at a joint between the two portions, and the outer surface is substantially planar at the joint.

9. The securing device according to claim 8, wherein at least one of the first wall portion or the second wall portion comprises a sensor.

* * * * *

UNITED STATES PATENT AND TRADEMARK OFFICE

CERTIFICATE OF CORRECTION

PATENT NO. : 7,584,566 B2
APPLICATION NO. : 11/836442
DATED : September 8, 2009
INVENTOR(S) : Hugh Victor and Steven Lawrence Carolin It is certified that error appears in the above-identified patent and that said Letters Patent is hereby corrected as shown below:

Column 5, line 33 Claim 1 - please replace "wail" with "wall".

Signed and Sealed this

Thirteenth Day of July, 2010

David J. Kappos

David J. Kappos
*Director of the United States Patent and Trademark Office*